United States Patent [19]

Hurst et al.

[11] 4,432,945

[45] Feb. 21, 1984

[54] REMOVING OXYGEN FROM A SOLVENT EXTRACTANT IN AN URANIUM RECOVERY PROCESS

[75] Inventors: Fred J. Hurst, Oak Ridge; Gilbert M. Brown, Knoxville; Franz A. Posey, Concord, all of Tenn.

[73] Assignee: The United States of America as represented by the Department of Energy, Washington, D.C.

[21] Appl. No.: 318,081

[22] Filed: Nov. 4, 1981

[51] Int. Cl.[3] ..... C01G 43/00

[52] U.S. Cl. ..... 423/10; 423/8; 423/321 S

[58] Field of Search ..... 423/8, 10, 321 S

[56] References Cited

U.S. PATENT DOCUMENTS

| | | | |
|---|---|---|---|
| 2,860,031 | 11/1958 | Grinstead | 423/10 |
| 2,866,680 | 12/1958 | Long | 423/10 |
| 3,214,239 | 10/1965 | Hazen et al. | 423/10 |
| 3,711,591 | 1/1973 | Hurst et al. | 423/10 |
| 4,243,637 | 1/1981 | Bradford et al. | 423/10 |
| 4,278,640 | 7/1981 | Allen et al. | 423/10 |
| 4,323,540 | 4/1982 | Sundar | 423/10 |

OTHER PUBLICATIONS

Hurst et al, "Recovery of Uranium from Wet Process Phosphoric Acid", Ind. Eng. Chem. Process, 11, pp. 122–128 (1972).

MacCready et al, "Uranium Extraction from Florida Phosphates", *Nucl. Tech.*, 53, pp. 344–353 (1981).

*Primary Examiner*—Edward A. Miller

*Attorney, Agent, or Firm*—C. Clay Carter; Stephen D. Hamel; Richard G. Besha

[57] ABSTRACT

An improvement in effecting uranium recovery from phosphoric acid solutions is provided by sparging dissolved oxygen contained in solutions and solvents used in a reductive stripping stage with an effective volume of a nonoxidizing gas before the introduction of the solutions and solvents into the stage. Effective volumes of nonoxidizing gases, selected from the group consisting of argon, carbon dioxide, carbon monoxide, helium, hydrogen, nitrogen, sulfur dioxide, and mixtures thereof, displace oxygen from the solutions and solvents thereby reduce deleterious effects of oxygen such as excessive consumption of elemental or ferrous and accumulation of complex iron phosphates or cruds.

8 Claims, No Drawings

REMOVING OXYGEN FROM A SOLVENT EXTRACTANT IN AN URANIUM RECOVERY PROCESS

FIELD OF THE INVENTION

The present invention relates to the art of extractive metallurgy and, more particularly, to solvent extraction processes for the selective recovery of uranium from wet-process phosphoric acid solutions by sparging the solvent phase with a nonoxidizing gas to reduce oxygen therein prior to conducting said extraction. This invention was made as a result of a contract with the United States Department of Energy.

BACKGROUND OF THE INVENTION

It is estimated that domestic phosphate reserves currently contain about 0.015% by weight of uranium as $U_3O_8$ which corresponds to more than 600,000 tons of extractable uranium. Exploitation of the uranium in these reserves during the manufacture of phosphatic fertilizers provides industry with a unique opportunity to develop an alternate source of uranium, a metal of considerable industrial and strategic importance. Satisfactory commercial production of phosphatic fertilizers involves the production of wet-process phosphoric acid wherein phosphate rock is acidulated with a mineral acid such as sulfuric acid.

Several processes have been developed for effecting the selective recovery of uranium from wet-process phosphoric acid solutions. One such process is described in commonly assigned U.S. Pat. No. 3,711,591 issued Jan. 16, 1973 in the names of Fred J. Hurst and David J. Crouse. Inasmuch as the present invention is preferably used in conjunction with this patented process, the aforementioned patent is incorporated herein by reference. While the present invention is described herein as being practiced with the incorporated patent, it will appear clear that the present invention may also find application in other known processes used for the selective recovery of uranium from wet-process phosphoric acid solutions.

Generally, the process of the aforementioned patent provides a two-cycle procedure for extraction of uranium from wet-process phosphoric acid solutions by successive and selective manipulations of the uranium valence state to promote transfer of the uranium between the appropriate phases. In the first cycle, hexavalent uranium is removed from the phosphoric acid solution by extraction into a first mixture of organic solvents and then subjected to a reductive strip solution of phosphoric acid and ferrous [Fe(II)] ions dissolved therein in sufficient amount to facilitate reduction of uranium from the hexavalent to the tetravalent state. This reductive step increases uranium concentration by a factor of up to about 100. In the second cycle, the uranium-loaded reductive strip solution is contacted with a second mixture of organic solvents to transfer uranium to an organic phase from which it is stripped by contact with an ammonium carbonate solution to form a precipitated ammonium uranyl tricarbonate compound. This compound is thermally decomposed at effective temperatures to produce a $U_3O_8$ product acceptable for uranium enrichment processes.

The preferred organic solvent for practice of the present invention is the organic solvent utilized in the above-described patent which is a synergistic solvent mixture of di(2-ethylhexyl) phosphoric acid (DEPA) and trioctylphosphine oxide (TOPO) dissolved in a high boiling aliphatic hydrocarbon diluent. As utilized hereinafter, reference to organic solvents shall mean a 0.5 M DEPA-0.125 M TOPO mixture dissolved in n-dodecane (NDD). Results comparable to those obtained herein for NDD in the practice of the present invention are expected for other aliphatic diluents such as kerosene and commercial solvent formulations. The subject method may also be applied to other organic solvents known in the art for uranium recovery. For example, other phosphonate and phosphine oxide mixtures have been described for such purposes in such publications as "Solvent Extraction of Uranium From Wet-Process Phosphoric Acid," by Fred J. Hurst, et al, ORNL/TM-2522, Oak Ridge National Laboratories, Oak Ridge, Tenn. (April 1969). Copies of the foregoing report may be purchased from the U.S. Department of Commerce, NTIS Center, Port Royal Road, Springfield, Va. 22161.

While the recovery of uranium from wet-process phosphoric acid solutions by the aforementioned patented process has been successful, some problems have developed in the practice of the process which led to the inability of the reductive strip stage of the process to effect adequate reduction of uranyl ion [U(VI)] to uranous ion [(U(IV)]. This deficiency has a significant impact on economic attractiveness of the process and impedes efficient uranium recovery.

In order to maintain adequate levels of reduction, the quantity of elemental or ferrous iron added to the reductive strip stage had to be significantly increased. This increased iron concentration, up to about 10 times the stoichiometric amount, was economically unattractive and also created severe operating problems in and downstream of the reductive strip stage. For example, the excess iron not removed in product streams as a contaminant accumulates as complex iron phosphates and cruds within process vessels and related equipment requiring frequent and undesirable downtime for maintenance. Solids accumulation has also been identified as one of the major causes of inordinate solvent losses by the formation of stabilized emulsions. Also, a significant amount of this excess ion may be introduced to the second cycle where it can contaminate the ammonium uranyl tricarbonate product to such a degree that it may be unsuitable without additional purification. In an effort to alleviate the foregoing problems, it has been suggested that conducting the reductive strip stage of the process in a controlled inert gas environment may reduce iron consumption and minimize solids accumulation. Implementation of this procedure, however, has been ineffective for controlling the aforementioned problems.

SUMMARY OF THE INVENTION

Therefore, it is an object of the present invention to provide an efficient and economic method for recovery of uranium from wet-process phosphoric acid solutions without necessitating the consumption of excess iron or suffering excessive solids accumulation in process equipment while simultaneously increasing uranium recovery.

It is yet another object of the invention to provide a method of the foregoing characteristics which is compatible with the process of U.S. Pat. No. 3,711,591 and significantly increases the economic attractiveness thereof by reductions in capital investment and operating costs.

To achieve the foregoing and other objects, the method of the present invention comprises sparging dissolved oxygen contained in solutions used in a reductive stripping stage with an effective volume of a nonoxidizing gas before the introduction of the solutions into the stripping stage.

It has been found that the problems associated with excessive consumption of elemental or ferrous iron, and with solids accumulation in process vessels and related equipment, are due to the presence of oxygen in the various solutions and equipment used in the commercial-scale practice of the aforementioned patent. The main source of extraneous oxygen has been identified as the very high dissolved oxygen content of the organic extractant or solvent used in the reductive strip stage. Therefore, the process problems of the described patent are significantly reduced by the elimination or reduction of potential and existing sources of oxygen within the various solutions and stages used to practice the process. This goal is achieved by the combined effects of sparging dissolved oxygen containing solutions with a nonoxidizing gas and also by maintaining the solutions and the reductive stripping stage of the process wherein the solutions are contacted under a controlled environment of nonoxidizing gas. Effective amounts of a nonoxidizing gas are required in the present invention to achieve the sparge and maintain the controlled environment.

DETAILED DESCRIPTION

In accordance with the present invention, discovery that the principal source of extraneous oxygen is the dissolved oxygen in the organic solvent utilized in the reductive strip stage in the uranium recovery process described in assignee's aforementioned patent was unexpected. From prior experience, it was thought that the solvent and the reductive strip solution would contain about equivalent amounts of dissolved oxygen. However, several tests have verified that the oxygen solubility in the organic solvent can approach about 0.23 g of oxygen per liter of solvent which represents a concentration of approximately ten times greater than the reductive strip solution.

It was further found that the foregoing problems may be aggravated by the utilization of over-size process equipment for uranium recovery operations. The nonutilized volumes and the turbulence generated during solution transfer or mixing provide numerous sources for the introduction of oxygen into process solutions or vessels. Stoichiometrically, about two moles of ferrous ion [Fe(II)] are required to reduce about one mole of uranyl [U(VI)] ion to uranous ion [U(IV)] while only one mole of oxygen will consume about four moles of ferrous ion. With the presence of oxygen at near saturation levels, it was also found that about two times as much ferrous ion can be oxidized to ferric ion [(Fe(III)] than is required to accomplish the reduction of uranium. Moreover, the large surface-area generated during solvent extraction processes by dispersal of the reductive strip solution within a continuous phase of organic solvent can have a catalytic effect thereby increasing the oxidation of ferrous ion. Since the means for providing ferrous ions to the reductive strip solution is by the addition of sufficient quantities of sources of iron to said solution, the iron make-up as well as ferrous ion consumption can be markedly reduced in accordance with the present invention by displacement of oxygen containing gases throughout the process, and more specifically, in the reductive stripping stage, of the aforementioned patent.

Nonoxidizing or carrier gases for practice of the present invention may be selected from the group of gases consisting of argon, carbon dioxide, carbon monoxide, helium, hydrogen, nitrogen, sulfur dioxide, and mixtures thereof. It is preferable, however, that the inert gas be heavier than air to achieve maximum oxygen reduction during process steps. For effecting the solvent extraction step of this invention, any well-known means for conducting liquid-liquid contact may be used such as laboratory glassware, commercial mixer-settlers, pulse columns, or any other vessel suitable for liquid-liquid contact. Preferably, the sparging zone or zones will be located immediately prior to or within the liquid-liquid contactor so that entering DEPA-TOPO solvents and reductive strip solutions may be sparged with the nonoxidizing gas and thereafter maintained under a controlled nonoxidizing gas atmosphere until the liquid-liquid extraction is complete. Displaced oxygen and excess nonoxidizing gas within the solvent extraction stage are vented to the environment. However, for economic reasons in commercial practice, it may be desirable to recycle excess nonoxidizing gas with appropriate controls for oxygen elimination from the recycle system.

The reductive strip solution may be selected from any convenient source of about 5 to 12 molar phosphoric acid. One convenient source is the aqueous raffinate from the first extraction cycle since it has suitable iron and phosphoric acid concentration while also containing sufficient fluoride ion to efficaciously catalyze the reduction reaction. Other sources of phosphoric acid may also be adapted for use in the process of the present invention by addition of water and appropriate solution constituents.

In order to further demonstrate the effectiveness of the method of the present invention in a uranium extraction process of the character described, the following experiments are presented by way of example. While the subject method may be conducted continuously or batch-wise in a plurality of contact stages, the following examples are directed only to single-stage operations for purposes of describing the invention. Improved results may be expected for the uranium recoveries below when additional stages of contact or customary process temperatures, such as set forth in the aforementioned patent are utilized. The following data, obtained at ambient temperature (about 25° C.), are within the lower range of the recommended temperatures for practicing the process in assignee's aforementioned patent. While it is possible that the dissolved oxygen solubilities of solutions contacted at the preferred process temperatures of the aforementioned patent may be somewhat lower than reported herein, it would be expected that the higher temperature would also increase the rate of oxidation of ferrous ion to levels higher than those experienced at room temperature.

EXAMPLE I A 30 ml sample of DEPA-TOPO solvent was loaded with about 0.025 mmoles of [U(VI)] and contacted for about 16 hours in a sealed vial with 3 ml of 6 M $H_3PO_4$ containing about 0.054 mmoles of [Fe(II)]. In accordance with the present invention, an attempt was made to virtually eliminate all sources of oxygen from the system. This was accomplished by sparging the solvent with argon and then maintaining the sparged solvent and acid solutions under a controlled environment of argon gas. The vial was also purged and thereafter maintained under a controlled argon environment before introduction of the aforementioned sparged solutions. Following separation and chemical analysis of the phases, it was determined that 45% of the uranium was stripped in this protracted contact while the mole ratio of Fe(II) oxidized to uranium stripped was 2:1, or the stoichiometric ratio.

In an identical procedure, the above experiment was repreated without sparging the solvent and maintaining the argon environment but only 10% of the uranium was stripped from the solvent. Further, the mole ratio of Fe(II) oxidized to uranium stripped showed a dramatic increase to 20:1, or 10 times the stoichiometric ratio. It should be understood in comparing the results of the above procedures that about 1.5% of the uranium present as U(VI) would be transferred irrespective of the presence of ferrous ion or oxygen containing gas. Such a low percentage, however, is an impractical distribution for efficient uranium recovery procedures. This distribution also impedes proper functioning of the reductive strip stage of the patented process by reducing the kinetics of uranyl ion reduction when ferrous ion is present and accounts for the long residence times (several hours) required to reduce and strip uranium even in the absence of oxygen containing gas.

It is readily apparent from comparison of the two experiments of this example that efficient reductive stripping is a key to successful uranium extractions since about a 6 fold increase in separated uranium can be obtained in the presence of Fe(II) over that attainable without Fe(II). However, an even more dramatic recovery (30 fold) is obtained by practice of the subject method with the same amount of iron.

EXAMPLE II

To show the effects of an excess concentration of iron, protracted contact time, and incomplete elimination of oxygen-containing sources, a series of experiments were run utilizing the variables reported in Table I. Only the organic solvents were presparged in these experiments allowing oxygen to be present in the reductive strip solution and the vial-free air space above liquid level in vial space. A 10 ml reductive strip solution of 6 M $H_3PO_4$ containing about 1.84 mmoles of Fe(II) was utilized in these experiments to simulate approximate iron concentations experienced in commercial-scale practice of the process in assignee's aforementioned patent.

TABLE I

| | | | $N_2$ Sparged Organic Solvents | | | |
|---|---|---|---|---|---|---|
| Run No. | Aqueous/Organic Ratio | U(VI) (mmoles) | Contact Time (Minutes) | Excess Iron (Moles Fe(II)/Moles U(VI)) | Uranium Stripped From Organic Phase (%) | Mole Ratio Fe(II) Oxidized/ Uranium Stripped |
| A | 2/1 | 0.0067 | 15 | 275 | 57 | 2/1 |
| B | 1/1 | 0.0034 | 60 | 535 | 90 | 22/1* |

*The high consumption of ferrous ion reported for the extended contact times of Runs B and D are attibutable to the presence of oxygen in the free volume of mixing and stripping vessels.

TABLE II

| | | | Unsparged Organic Solvents | | | |
|---|---|---|---|---|---|---|
| Run No. | Aqueous/Organic Ratio | U(VI) (mmoles) | Contact Time (Minutes) | Excess Iron (Moles Fe(II)/Moles U(VI)) | Uranium Stripped From Organic Phase (%) | Mole Ratio Fe(II) Oxidized/ Uranium Stripped |
| C | 2/1 | 0.0067 | 15 | 275 | 49 | 19/1 |
| D | 1/1 | 0.0034 | 60 | 535 | 90 | 66/1* |

*The high consumption of ferrous iron reported for the extended contact times of Runs B and D are attributable to the presence of oxygen in the free volume of mixing and stripping vessels.

From the data of Tables I and II, it can be seen that prolonged residence time during the liquid-liquid extraction can increase uranium recovery, but said benefit is at the expense of increased iron consumption. Molar ratios of oxidized ferrous ion to uranium stripped in the range of ten to sixty times the stoichiometric ratio are highly undesirable for accomplishing efficient uranium recovery. Therefore, it is preferable that exclusion of oxygen or air from all potential sources be maximized in the practice of the present invention although satisfactory results may be obtained if just the organic solvent solution is depleted of dissolved oxygen. In declining order, additional increments of reduced iron consumption may be had if oxygen is also displaced from the vessel free space and the reductive strip solution, respectively, by a nonoxidizing gas. It is also preferable that mixing processes and residence time be reduced to a minimum.

EXAMPLE III

A series of experiments were run without uranium present to determine the effect of Fe(II) concentration of a typical reductive strip solution of 6 M $H_3PO_4$ containing about 10 mg of Fe(II) per ml wherein a 2/1 DEPA-TOPO solvent and strip solution mixture were exposed for 15 minutes of contact time to various gases. The results are summarized in Table III and are sufficient to indicate the predominant source of excessive iron consumption.

Referring to the data of Table III, the deleterious effects of oxygen containing gases in the vial free space and in the reductive strip solution in Runs E through G can be seen in comparison to Run H wherein virtual elimination of such gases was accomplished in accordance with the inventive concept of the subject method. Run E demonstrates that an oxygen enriched solvent attains an upper level of about 0.23 mg $O_2$/ml solvent which is in excellent agreement with the value we obtained by Henry's Law. Assuming that air is about 20% oxygen, it would be expected that the oxygen equivalent of untreated solvent in equilibrium with air would approach 0.048 mg $O_2$/ml solvent based on the value obtained in Run E. The value obtained in Run F, however, is much higher, i.e., 0.095, indicating the importance of removing oxygen containing gases from the vessel-free space as well as from the solvent.

TABLE III

| Ferrous Ion Consumption In Presence of Various Gases | | | | | |
|---|---|---|---|---|---|
| | | Fe(II) Concentration (mmoles) | | Percent Fe(II) | Oxygen Equivalent |
| Run No. | Sparge Gas | Initial | Consumed | Oxidized | (mg $O_2$/ml solvent) |
| E | Oxygen | 1.84 | 0.287 | 15.6 | 0.23 |
| F | None | 1.84 | 0.12 | 6.5 | 0.095 |
| G | Nitrogen | 1.84 | 0.084 | 4.6 | 0.067 |
| H | Argon | 1.84 | <0.002 | <0.1 | <0.001 |

Utilization of a pure nitrogen sparge, as in Run G, is effective for further reducing the oxygen equivalent although significant iron oxidizing conditions are still present from the vessel-free space.

Thus, it will readily be concluded that the method of the present invention provides the art of uranium extraction from phosphoric acid solutions with an effective and compatible procedure for considerably enhancing the production of by-product uranium in facilities manufacturing phosphatic fertilizers by the wet-process method.

We claim:

1. In a method for effecting the selective recovery of uranium from a wet-process phosphoric acid solution by solvent extraction comprising the steps of contacting said solution with an organic solvent extractant containing dissolved oxygen to extract uranium from said solution and thereafter stripping the extracted uranium from the extractant by contacting the solvent mixture with a reductive strip solution of phosphoric acid and ferrous ion; the improvement comprising sparging said extractant with a nonoxidizing gas, thereby removing sufficient deleterious dissolved oxygen therefrom prior to contact with said reductive strip solution to effectively decrease the consumption of ferrous ion in the stripping step.

2. The method claimed in claim 1 wherein the reductive strip solution contains dissolved oxygen, and including the additional step of sparging said reductive strip solution with a nonoxidizing gas to remove deleterious dissolved oxygen therefrom prior to contact with said solvent mixture.

3. The method claimed in claim 1 wherein the wet-process phosphoric acid solution contains dissolved oxygen, and wherein deleterious dissolved oxygen is sparged from the extractant and the wet-process phosphoric acid solution during contact of said with said wet-process phosphoric acid solution.

4. The method claimed in claim 1 wherein the deleterious dissolved oxygen is sparged from the extractant prior to contact thereof with said wet-process phosphoric acid solution.

5. The method claimed in claim 1 including the additional step of providing an atmosphere of nonoxidizing gas over said extractant and said reductive strip solution during said extracting and stripping steps.

6. The method claimed in claim 1 wherein the extractant comprises di(2-ethylhexyl) phosphoric acid and trioctylphosphine oxide in an aliphatic diluent.

7. The method claimed in claim 16 wherein the reductive strip solution consists of 5–12 M phosphoric acid and ferrous iron.

8. The method claimed in claim 1 wherein the nonoxidizing gas is selected from the group consisting of argon, carbon dioxide, carbon monoxide, helium, hydrogen, nitrogen, sulfur dioxide, and mixtures thereof.

* * * * *